United States Patent [19]

Kalippke et al.

[11] 3,964,453

[45] June 22, 1976

[54] INTERNAL COMBUSTION ENGINE ELECTRIC IGNITION BREAKER CONTACT STRUCTURE

[75] Inventors: Harald Kalippke, Hohenacker; Günter Brand, Stuttgart, both of Germany

[73] Assignee: Robert Bosch G.m.b.H., Gerlingen-Schillerhohe, Germany

[22] Filed: Oct. 9, 1974

[21] Appl. No.: 513,224

[30] Foreign Application Priority Data

Oct. 9, 1973 Germany ..... 2350562

[52] U.S. Cl. ..... 123/146.5 A; 200/19 A; 200/30 A

[51] Int. Cl.[2] ..... H01H 19/62; F02P 7/02

[58] Field of Search ..... 123/146.5 A; 200/30 A, 200/30 AA, 31 A, 19 A

[56] References Cited

UNITED STATES PATENTS

| | | | |
|---|---|---|---|
| 1,851,567 | 3/1932 | Davis, Jr. et al. | 200/30 A |
| 2,696,534 | 12/1954 | Mallory | 200/30 A |
| 2,847,524 | 8/1958 | Slick | 200/30 A |
| 3,003,043 | 10/1961 | Meyer, Jr. et al. | 200/30 AA |

OTHER PUBLICATIONS

"DuPont-Vespel Prazisionsteile-Konstruktionshandbuch," copyright 1972 by DuPont de Nemours International S.A. Genf., Schweiz.

*Primary Examiner*—Charles J. Myhre
*Assistant Examiner*—Tony Argenbright
*Attorney, Agent, or Firm*—Flynn & Frishauf

[57] ABSTRACT

To match the wear and flattening of ignition breaker contacts to wear of the engagement element of the breaker contact arm with the breaker cam, the engagement element is made of polyimide, preferably sintered polyimide with, possibly, an additive of from 10 to 20% of a lubricating substance, for example about 15% graphite (by weight).

7 Claims, 2 Drawing Figures

INTERNAL COMBUSTION ENGINE ELECTRIC IGNITION BREAKER CONTACT STRUCTURE

The present invention relates to a breaker contact for the ignition system of internal combustion engines, in which a movable contact is lifted off a fixed contact by means of a camming arrangement, the movable contact being mechanically supported on a contact arm which bears by means of a bearing element against a rotatable breaker cam, and is maintained against the cam by means of a bias element, such as a spring.

Breaker contacts of this type are used to trigger the ignition event in internal combustion engines by controlling current flow to a spark plug. The invention is specifically directed to the construction of the breaker contact.

Various types of insulating materials have been proposed for use in the support element, or support pin which bears against the cam of the breaker contact. Difficulties have been experienced regarding wear thereof on the surface engaged by the cam, and the relationship of flattening, or wear of the surface with respect to the camming surface, during operation, interfered with proper contact operation, since the wear on the contacts, and the wear on the cam, or the respective bearing element, was not related. The deflecting pin should, preferably, wear approximately evenly with wear of the breaker contacts themselves, so that the flattening of the contacts, due to repeated opening and closing, is compensated. Wear of the contact pin or element, if matched to wear of the contact, then retains the relative time of triggering the ignition event in its originally determined timing point, even after comparatively long periods of operation, thus improving the long-term performance of a once tuned internal combustion engine.

It is an object of the present invention to provide a breaker contact construction which is improved with respect to that of the prior art and which meets the above referred to requirements.

SUBJECT MATTER OF THE PRESENT INVENTION

Briefly, the engagement element or engagement pin which supports the breaker contact with respect to the cam is, at least in the part which bears against the cam, made of a polyimide; it is formed with a rounded surface which fits against the camming surface of the breaker cam and is shaped so that the engagement element wears evenly with the flattening of the contacts.

Figure 1:
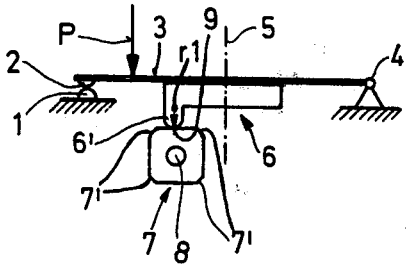
Figure 2:
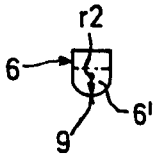

The invention will be described by way of example with reference to the accompanying drawings, wherein:

FIG. 1 is a highly schematic side view showing the general structure of a breaker contact; and FIG. 2 is a front view of the deflection pin or element used in the breaker contact, separately and apart from the breaker contact assembly of FIG. 1.

The ignition system of an internal combustion engine, not shown, and which may be of any suitable type, has a fixed contact 1 (FIG. 1) and a movable contact 2. The movable contact is located at the end of a contact arm 3 which is rotatable about a swing axis 4. An attachment element 5, shown only schematically by the chain-dotted line, secures the deflection element 6 to the contact arm 3. The deflection element 6 has a projection 6', which extends at right angles therefrom to form a deflection pin, or deflection element which bears against a cam 7 located on a cam shaft 8. The cam shaft 8 rotates in synchronism with rotation of the engine (not shown). The deflection element 6 is biassed to bear against the cam 7 by a force P, shown schematically only, and obtained, for example, by a suitable bias spring bearing against arm 3.

The longitudinal edges 7' of the cam 7 pass by the edges 6' of the deflection element 6 and, upon rotation, move the contact arm 3 counter the force P to swing about the shaft axis 4. The movable contact 2 is thus lifted from engagement with the fixed contact 1.

The contacts 1, 2 rapidly and frequently impinge on each other and, therefore, in time, will flatten. The deflection element 6 slides with its sliding surface 9 on the cam 7. In operation, and upon breaking of the contact between terminals 1 and 2, sparking may occur which additionally deforms the contact surfaces, causing pitting and, further, flattening particularly if the contacts slap against each other while still hot from just terminated sparking. The flattening of the contacts 1, 2 is approximately compensated, in accordance with the present invention, by forming the deflection element 6 at least in the region 6' which bears against the cam 7 of a material which matches the wear of the contacts. In accordance with the invention, this material is polyimide. To match the wear of the deflection element 6 properly to the flattening of the contacts 2, the surface 9 of the deflection element 6 which engages the cam 7 is rounded, so that contact of the surface 9 with the respective side surface of the cam 6 is along a point, or along a line perpendicular to the plane of the drawing. By suitable choice of the radius *r*1 (FIG. 1), and of radius *r*2 which is shown in greater enlargement in FIG. 2, and of the material of the element 6', wear of the deflection element or pin 6 can be matched to flattening of the contacts 1, 2. The characteristics of the material polyimide are particularly suited for such matching of wear. The deflection element 6, in accordance with a particularly suitable embodiment, is made of sintered polyimide at least in the region 6' which engages the cam 7. To improve lubrication, the polyimide may have a self-lubricating material, preferably graphite, added thereto. A suitable range is from 10 to 20%, preferably about 15% (by weight) of graphite additive to the polyimide.

Contacts 1, 2 which have a flattening characteristic which matches that of the wear characteristic of a polyimide deflection element are made, for example, as follows:

contact diameter: 4,2 millimeters contact height (extension of the contacts from the support, or the arm 3, respectively): 1,2 millimeters material of fixed contact 1: tungsten material of movable contact 2: tungsten.

The contact face of at least one of the contacts 1, 2 is spherical having a radius of 20 millimeters.

Material of cam 7: carburized steel

The deflection element 6 is made, for example, as follows:

radius *r*1 of the region 6': 2 millimeters radius *r*2 of the region 6': 10 millimeters cross section of region 6': 2,5 millimeters x 6 millimeters commercial designation of material of element 6: "SP 21" (such a useful polyimide for the manufacture of the element 6 is disclosed in "Du Pont-Vespel Prazisionsteile-Konstruktionshandbuch" Copyright 1972 by Du Pont de Nemours International S.A. Genf, Schweiz.

We claim:

1. Internal combustion engine ignition apparatus including an ignition breaker contact structure comprising a fixed contact (1), a movable contact (2), a contact arm (3) carrying the movable contact, a cam (7) and an engagement element (6) connected to the contact arm (3) and in engagement with the cam (7), and moving the contact arm (3) between open, and closed position, in dependence on the position of the cam (7) with respect to the engagement element (6), wherein the improvement comprises the portion (6') of the engagement element (6) bearing against the cam (7) comprising polyimide; and the engagement element (6) in the region engaging the cam (7) is formed with a rounded, or curved surface (9) to engage the cam (7) therewith, said surface (9) being rounded in two transverse directions, the radius of curvature (r1, r2) in the respective directions being selected such that, in operation, wear of said surface, upon engagement of said surface (9) with the cam (7), approximately matches the flattening of the contacts (1, 2) upon repeated opening and closing of the contacts due to movement of the contact arm in dependence on the position of the cam (7) with respect to said engagement element (6).

2. Apparatus according to claim 1, wherein the portion (6') of the engagement element (6) engaging the cam (7) comprises sintered polyimide.

3. Apparatus according to claim 1, further comprising a self-lubricating substance added to the polyimide.

4. Apparatus according to claim 3, wherein the self-lubricating substance comprises graphite.

5. Apparatus according to claim 3, wherein the self-lubricating substance is present in a quantity of about from 10 to 20% by weight.

6. Apparatus according to claim 5, wherein the self-lubricating substance comprises graphite and is present in about 15% by weight.

7. Apparatus according to claim 1, wherein the respective radii are about 2 mm (*r1*) and 10 mm (*r2*).

* * * * *